US007305996B2

(12) United States Patent
Kraft et al.

(10) Patent No.: US 7,305,996 B2
(45) Date of Patent: Dec. 11, 2007

(54) ELASTIC BAND

(75) Inventors: Sarah Kraft, Atlanta, GA (US); Lau P. Chiu, Kowloon Bay (CN)

(73) Assignees: Goody Products, Inc., Freeport, IL (US); Goodway (Far East) Industrial Ltd., Kowloon Bay (HK)

( * ) Notice: Subject to any disclaimer, the term of this patent is extended or adjusted under 35 U.S.C. 154(b) by 48 days.

(21) Appl. No.: 11/272,996

(22) Filed: Nov. 14, 2005

(65) Prior Publication Data

US 2006/0157077 A1 Jul. 20, 2006

Related U.S. Application Data

(60) Provisional application No. 60/628,148, filed on Nov. 16, 2004.

(51) Int. Cl.
*A45D 8/04* (2006.01)
*B65B 63/00* (2006.01)

(52) U.S. Cl. ..... 132/273; 24/17 B

(58) Field of Classification Search ..... 132/273, 132/275; 2/243.1, 221, 237, 76; 24/17 B, 24/16 R, 715.3, 482
See application file for complete search history.

(56) References Cited

U.S. PATENT DOCUMENTS

| | | | | |
|---|---|---|---|---|
| 3,000,119 | A | 9/1961 | Altman | |
| 3,778,845 | A | 12/1973 | Miller | |
| 5,375,266 | A * | 12/1994 | Crisco | 2/243.1 |
| 5,727,574 | A * | 3/1998 | Frye | 132/210 |
| 5,758,671 | A | 6/1998 | Thim | |
| 5,787,904 | A * | 8/1998 | Michaud | 132/200 |
| 5,920,909 | A * | 7/1999 | Ellsworth et al. | 2/171 |
| 6,000,408 | A | 12/1999 | Maturaporn | |
| 6,079,236 | A | 6/2000 | Ives et al. | |
| 6,499,144 | B1 | 12/2002 | Yan | |
| 6,516,637 | B1 | 2/2003 | Fancher et al. | |
| 6,701,532 | B1 | 3/2004 | Glassberg et al. | |
| 6,711,749 | B2 * | 3/2004 | White et al. | 2/195.8 |

FOREIGN PATENT DOCUMENTS

| | | |
|---|---|---|
| CN | 200420095683.5 | 11/2004 |
| CN | 200420095684.X | 11/2004 |
| DE | 2041765 | 8/1970 |
| GB | 314707 | 8/1928 |
| GB | 814886 | 6/1954 |

OTHER PUBLICATIONS

International Search Report from PCT/US2005/41100 (5 pages).
Written Opinion from PCT/US2005/41100 (6 pages).

* cited by examiner

*Primary Examiner*—Robyn Doan
(74) *Attorney, Agent, or Firm*—Marshall, Gerstein & Borun LLP

(57) ABSTRACT

An elastic band includes an elongate elastic core, a sheath, and an elongate friction member. The elongate elastic core comprising a continuous loop and the sheath has an outer surface and surrounds the elongate elastic core. The elongate friction member is disposed in the sheath, such that at least a portion of the elongate friction member protrudes past the outer surface of the sheath.

20 Claims, 3 Drawing Sheets

ELASTIC BAND

RELATED APPLICATION DATA

The present application is a non-provisional application based on, and claiming the priority benefit of, U.S. provisional application Ser. No. 60/628,148, which was filed on Nov. 16, 2004, and is expressly incorporated herein by reference.

TECHNICAL FIELD

The present disclosure relates generally to an elastic band and, more particularly, to an elastic band having a woven exterior that includes a friction member.

BACKGROUND OF THE DISCLOSURE

Elastic bands in general and elastic bands for retaining hair in bundles are generally known in the art. Such elastic bands come in a great variety of shapes and sizes and include different features.

For example, U.S. Pat. No. 6,701,532 discloses an elastic band having opposing ends that are coupled together to form an annular-shaped accessory. An outer face of the elastic band is decorated and can include a label and one or more circumferential stripe-like decorations printed or constructed thereon, so that there is no need to cover the surface of the band with a layer of additional fabric or other covering material.

In another example, U.S. Pat. No. 6,499,144 discloses a three-component band having two outer rows and a middle row. The two outer rows are of generally greater contraction than the middle row such that the middle row may flex to a greater degree than the outer rows, thereby forming a band for association with garments including hats, caps and underwear or the like. A moisture absorbing material, such as cotton, may be used in conjunction with the three-component band in order to provide absorption for perspiration or other moisture.

In another example, U.S. Pat. No. 6,516,637 discloses a warp knit elastic band that includes at least one filler yarn knitted into the band on an outside surface. A method for manufacturing the elastic band is also disclosed in which at least one filler yarn is laid into the band adjacent either a back weft yarn or a front weft yarn on a side thereof opposite the elastomer threads.

In another example, U.S. Pat. No. 6,079,236 discloses an elastic knitted band having a stretch woven appearance and feel. A filling yarn is secured to the elastic band by the conventional warp yarn chain stitches so as to become an integral component of the elastic knit band without creating warp or filling ridges.

SUMMARY OF THE DISCLOSURE

In accordance with one aspect of the disclosure, an elastic band including an elongate elastic core, a sheath, and an elongate friction member is disclosed. The elongate elastic core comprising a continuous loop and the sheath has an outer surface and surrounds the elongate elastic core. The elongate friction member is disposed in the sheath, and at least a portion of the elongate friction member protrudes past the outer surface of the sheath.

In accordance with another aspect of the disclosure an elastic band including an inner elongate elastic member, an inner elongate elastic member, and an outer woven member is disclosed. The inner elongate elastic member forms a continuous loop, and the outer woven member includes an outer surface and is disposed around the inner elongate elastic member. The elongate protruding member is attached to the outer woven member, such that at least a portion of the elongate protruding member protrudes past the outer surface of the outer woven member, and at least a portion of the outer woven member and at least a portion of the elongate protruding member are fixedly attached to the inner elongate elastic member.

In accordance with another aspect of the disclosure, an elastic band including an elongate elastic core, a woven sheath, and an elongate friction member is disclosed. The elongate elastic core includes a first end fixedly connected to a second end, and comprising a continuous loop. The woven sheath includes an outer surface and surrounds the elongate elastic core. The elongate friction member is woven into the sheath and is disposed around the core in a helical manner. At least a portion of the elongate friction member protrudes past the outer surface of the sheath.

Figure 1:
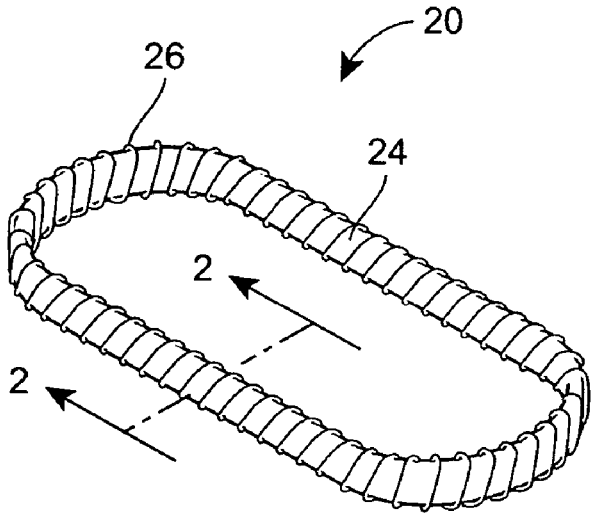
FIG. 1 is an isometric view of an elastic band according to one embodiment of the disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the appended claims.

DETAILED DESCRIPTION

Figure 2:
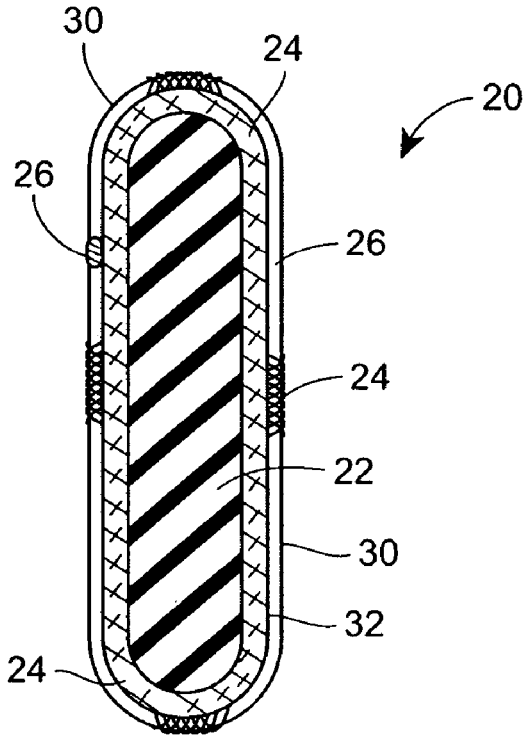
FIG. 2 is a cross-sectional view of the elastic band along line 2-2 of FIG. 1.

Referring now to the drawings and with specific reference to FIG. 1, an elastic band constructed in accordance with the teachings of the disclosure is generally depicted by reference numeral 20. As illustrated in FIG. 2, the elastic band 20, in this exemplary embodiment, includes a core 22, a sheath 24, and a friction member 26. The elastic band 20, as disclosed herein, may be disposed around objects, such as strands of hair. In one exemplary embodiment, the elastic band 20 may be used as a pony tail holder to hold or retain the strands of hair together. In such an example, the friction member 26 may allow the elastic band 20 to obtain a better hold around the strands of hair such that during use the elastic band 20 is better able to resist sliding or movement relative to the bundle of hair. Contemporaneously, the force or engagement of the elastic band 20 with the strands of hair is not so great as to cause excessive discomfort to the user from tugging of the hair when the elastic band 20 is removed.

The core 22 of the elastic band 20, as seen in FIG. 2, may be an elongate core 22 that is constructed from an elastic material, such rubber, plastic, natural rubber, silicone, or other elastic or visco elastic materials. The core 22 may form a continuous loop, but may also contain breaks there between. The core 22 may be constructed from one single piece formed as a loop or with opposite ends attached to form a loop, but may also be constructed from a plurality of pieces that may be connected in any known manner. For example, ends of the core 22 may be glued, melted, or stitched together, or may be connected by being covered in adhesive material or by being connected with a connection piece (such as one constructed of metal or plastic). The core 22 may have a generally rectangular cross-sectional area, as seen in FIG. 2, but may have other cross-sectional shape, such as round, oval, square, triangular, etc.

Figure 3:
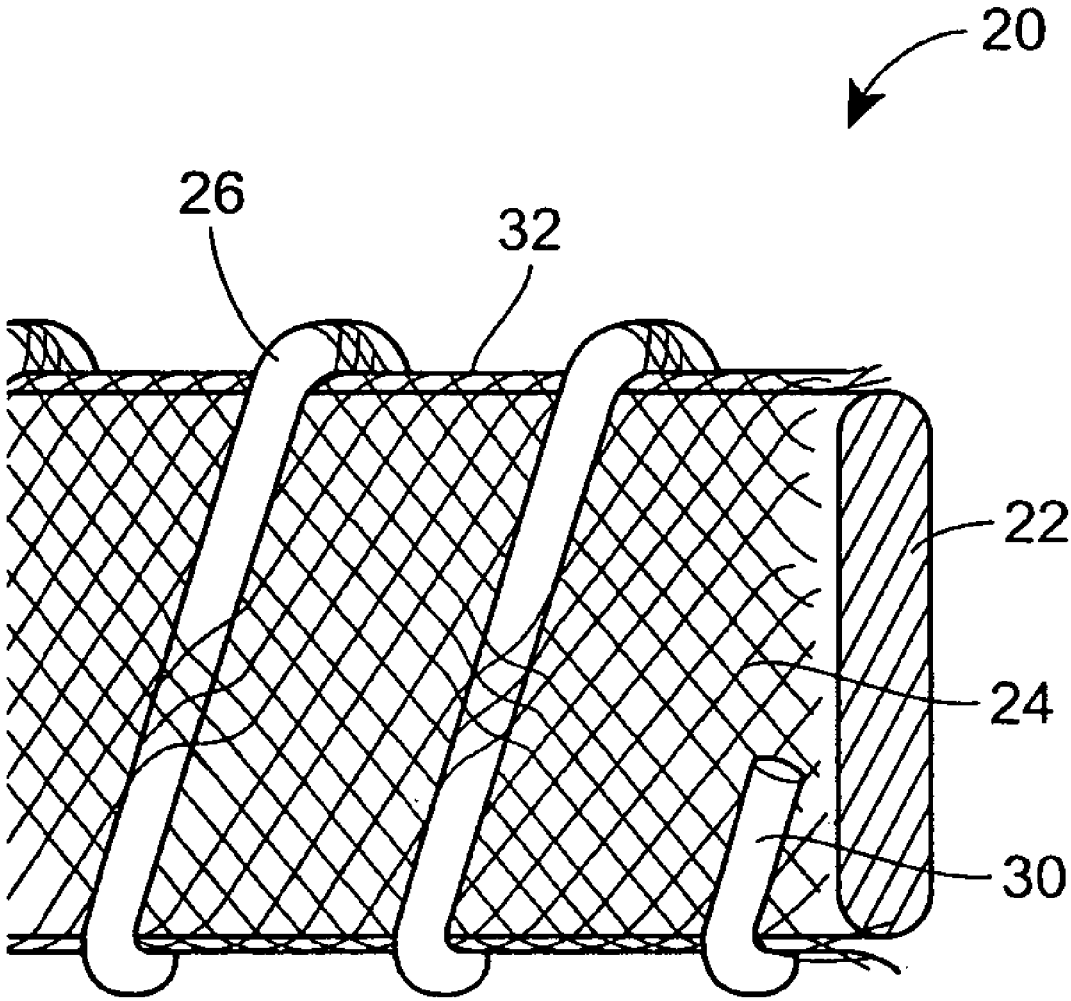
FIG. 3 is a detailed view of a portion of the elastic band of FIG. 1.

The sheath 24 of the elastic band 20, as seen in FIGS. 1 and 2, may be an elongate sheath 24 that is constructed from material, including but not limited to plastic, paper, cloth, and elastic or visco elastic materials, but could be any material that does not have excessive adhesion to the strands of hair. The sheath 24 may be a woven material, but may be constructed from a non-woven material as well, and may be constructed such that the sheath 24 can expand with the core 22 when the elastic band 20 is stretched. The sheath 24 may surround the entire core 22 and, as such, may have a ring-like shape, in the center of which is the core 22. As seen in FIG. 3, the sheath 24 may be woven in a criss-cross pattern with the friction member 26 threaded or woven through the sheath 24. The friction member 26 may, in this exemplary embodiment, be part of the weave thereby replacing one or more of the threads or bunches of threads of the weave, or may be an addition to the weave, such that the friction member 26 is simply disposed between the previously woven sheath 24.

The friction member 26 may be disposed at a surface of the sheath 24 such that additional threads or bundles of threads may be woven around the friction member 26 with portions of the friction member 26 exposed through an exterior of the sheath to the hair. Like the core 22, the sheath 24 the may form a continuous loop, but may also contain breaks there between. The sheath 24 may be constructed from one single piece, but may also be constructed from a plurality of pieces, that may be connected in any known manner. In one exemplary embodiment, ends of the sheath 24 may be connected at or substantially adjacent to the connection point of ends of the core 22.

The friction member 26, as seen in FIGS. 1-3, may be constructed from a material that preferably has a higher friction coefficient that the material of which the sheath 24 is constructed. The friction member 26 may be constructed from material, including but not limited, to plastic, rubber, natural rubber, silicone, or other elastic or visco elastic materials. The friction member 26 may form a continuous loop, but may also contain breaks there between. For example, the friction member 26 may be constructed from one single piece, but may also be constructed from a plurality of pieces, that may or may not be connected. In one exemplary embodiment, ends of the friction member 26 may be connected at or substantially adjacent to the connection point of the ends of the core 22 and/or the ends of the sheath 24. The friction member 26 may have a round cross-sectional area, as seen in FIG. 2, but may have other cross-sectional shapes, such as rectangular, oval, square, triangular, etc.

The friction member 26, as best seen in FIGS. 2 and 3, may be woven into the sheath 24, such that the friction member 26 becomes part of the woven sheath 24. In one exemplary embodiment, an outer surface 30 of the friction member 26 may extend outwardly from an outer surface 32 of the sheath 24, such that the friction member 26 may contact the object around which it is disposed. Additionally, the outer surface 30 of the friction member 26 may abut the core 22, as seen in FIG. 2. As such, a cross-sectional area of the friction member 26 may be larger, or substantially larger, than a cross-sectional area of the material of which the woven sheath 24 is constructed, thereby ensuring that at least a part of the friction member 26 contacts the object around which the elastic band 20 is disposed.

The above exemplary embodiment may include many variations thereof to achieve and/or create additional or alternative features. For example, the sheath 24 may be woven in other patters. More specifically, the sheath 24 may be constructed from a maypole braiding weaving pattern. Similarly, the friction member 26 may be attached to the elastic band 20 in alternate ways, including but not limited to gluing the friction member to the elastic band 20, such as with hot melt glue or cyanoacrylate glue, and stitching the friction member to the sheath 24. The adhesive can be applied at intervals along the length of the product to allow the stretch properties required for use to still be intact.

The elastic band 20 may be manufactured using any known braiding or weaving system or method, including but not limited to, a maypole braiding system and a flat braiding system. The maypole braiding system forms strands or fabrics by an operation commonly known as braiding or plating. Bobbins, or carriers having bobbins thereon, travel in predetermined paths. The carriers either pass each other so as to interlace the strands, or the strands leading from bobbins are caused to pass other bobbins to cause interlacing of the strands. The flat braiding system weaves three or more strands into a single braid by interlacing the strands longitudinally over one another.

Figure 4:
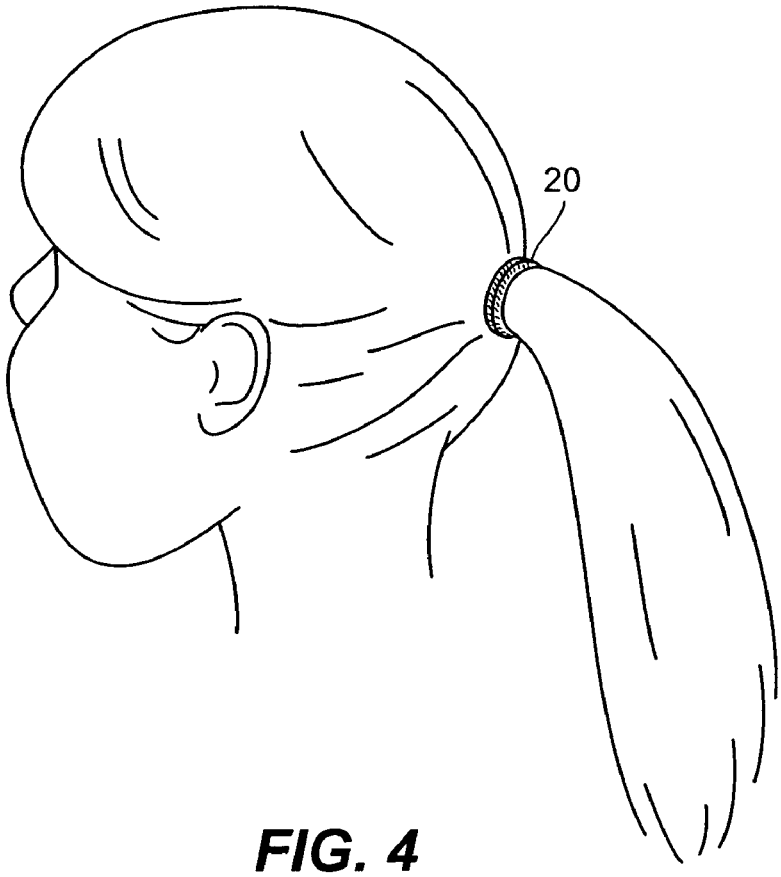
FIG. 4 is an isometric view of the elastic band of FIG. 1 placed around a user's strands of hair.
Figure 5:
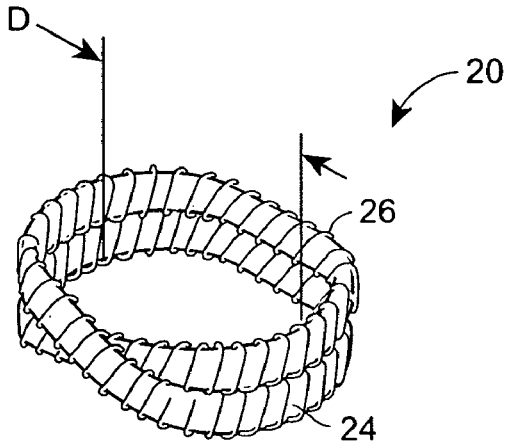
FIG. 5 is an isometric view of the elastic band of FIG. 1 twisted into a plurality of loops.

In operation, the user may dispose the elastic band 20 around any variety of objects and may be used to retain, hold, or control those or other objects. For example, as seen in FIG. 4, the elastic band 20 may be disposed around a bundle of hair to hold and retain the same. In this exemplary embodiment, the user may twist the elastic band 20 into a plurality of loops until the user has achieved a desired inner diameter D or a desired amount of retaining force of the elastic band 20, as seen in FIG. 5, but may utilize the elastic band 20 without twisting. The user need not, however, twist the elastic band 20 prior to disposing the elastic band 20 around the bundle of hair, but may achieve the desired inner diameter D or the desired amount of retaining force anytime during the use of the elastic band 20. Once the desired inner diameter D or the desired amount of retaining force has been achieved, the user may thread the bundle of hair through the inner diameter D of the elastic band 20, or conversely may expand the elastic band 20 around the bundle of hair.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. An elastic band, comprising:

an elongate elastic core comprising a continuous loop;

a sheath wrapped around and enclosing the elongate elastic core, the sheath having an inner surface facing the elongate elastic core and an outer surface facing outwardly away from the elongate elastic core; and an elongate friction member disposed in the sheath and fabricated from a material having a greater coefficient of friction than the material from which the sheath is fabricated, wherein at least a portion of the elongate friction member protrudes past the outer surface of the sheath.

2. The elastic band of claim 1, wherein the sheath is constructed from a woven fabric.

3. The elastic band of claim 2, wherein the woven fabric is constructed from at least one of cotton, silk, linen and metal material.

4. The elastic band of claim 1, wherein the elongate friction member is woven into the sheath.

5. The elastic band of claim 1, wherein the elongate friction is disposed around the core in a helical manner.

6. The elastic band of claim 1, wherein the elastic core includes a first and a second end that are fixedly connected with at least one of an adhesive material and a metal connecting part.

7. The elastic band of claim 1, wherein the core is constructed from at least one of a rubber, plastic, natural rubber, and silicone material.

8. The elastic band of claim 1, wherein a majority of the elongate friction member protrudes past the outer surface of the sheath.

9. The elastic band of claim 1, wherein a minority of the elongate friction member protrudes past the outer surface of the sheath.

10. The elastic band of claim 1, wherein at least a portion of the elongate friction member is fixedly attached to the elongate elastic core.

11. An elastic band, comprising:

an inner elongate elastic member comprising a continuous loop;

an outer woven member wrapped around and enclosing the inner elongate elastic member, the outer woven member having an inner surface facing the elongate elastic member and an outer surface facing outwardly away from the elongate elastic member; and an elongate protruding member attached to the outer woven member and fabricated from a material having a greater coefficient of friction than the material from which the outer woven member is fabricated, wherein at least a portion of the elongate protruding member protrudes past the outer surface of the outer woven member and wherein at least a portion of the outer woven member and at least a portion of the elongate protruding member are fixedly attached to the inner elongate elastic member.

12. The elastic band of claim 11, wherein the outer woven member is constructed from at least one of cotton, silk, linen and metal material.

13. The elastic band of claim 11, wherein the elongate protruding member is disposed around the inner elongate elastic member in a helical manner.

14. The elastic band of claim 11, wherein the inner elongate elastic member includes a first and a second end that are fixedly connected with at least one of an adhesive material and a metal connecting part.

15. The elastic band of claim 11, wherein a majority of the elongate friction member protrudes past the outer surface of the sheath.

16. The elastic band of claim 11, wherein the inner elongate elastic member has a generally rectangular cross-sectional shape.

17. The elastic band of claim 11, wherein at least a portion of the outer woven member is fixedly attached to the elongate protruding member.

18. The elastic band of claim 17, wherein the outer woven member is fixedly attached to the elongate protruding member at a connection between a first and a second end of the inner elongate elastic member.

19. The elastic band of claim 11, wherein the portion of the outer woven member and the portion of the elongate protruding member are fixedly attached to the inner elongate elastic member at a connection between a first and a second end of the inner elongate elastic member.

20. An elastic band, comprising:

an elongate elastic core having a first end fixedly connected to a second end, the core comprising a continuous loop;

a woven sheath wrapped around and enclosing the elongate elastic core, the sheath having an inner surface facing the elongate elastic core and an outer surface facing outwardly away from the elongate elastic core; and an elongate friction member woven into the sheath and disposed around the core in a helical manner, wherein at least a portion of the elongate friction member protrudes past the outer surface of the sheath, and wherein the elongate friction member is fabricated from a material having a greater coefficient of friction than the material from which the woven sheath is fabricated.

* * * * *

UNITED STATES PATENT AND TRADEMARK OFFICE

CERTIFICATE OF CORRECTION

PATENT NO. : 7,305,996 B2
APPLICATION NO. : 11/272996
DATED : December 11, 2007
INVENTOR(S) : Sarah Kraft and P. Chiu Lau It is certified that error appears in the above-identified patent and that said Letters Patent is hereby corrected as shown below:

Title Page
The correct name of the listed inventor "Lau P. Chiu" is "Lau, P. Chiu" (the surname is "Lau", not "Chiu"). Also, a Certificate of Correction is being contemporaneously filed in the continuation-in-part patent application serial number 11/329,311 which claims priority from this case.

Signed and Sealed this

First Day of June, 2010

David J. Kappos

David J. Kappos
*Director of the United States Patent and Trademark Office*